US009890506B2

(12) United States Patent
Weiner

(10) Patent No.: US 9,890,506 B2
(45) Date of Patent: Feb. 13, 2018

(54) BARRIER APPARATUS AND METHODS OF USE

(71) Applicant: Steven L. Weiner, Alamo, CA (US)

(72) Inventor: Steven L. Weiner, Alamo, CA (US)

( * ) Notice: Subject to any disclaimer, the term of this patent is extended or adjusted under 35 U.S.C. 154(b) by 551 days.

(21) Appl. No.: 14/613,828

(22) Filed: Feb. 4, 2015

(65) Prior Publication Data

US 2015/0218848 A1 Aug. 6, 2015

Related U.S. Application Data

(60) Provisional application No. 61/935,563, filed on Feb. 4, 2014.

(51) Int. Cl.

| | |
|---|---|
| ***E01F 13/02*** | (2006.01) |
| ***B65H 75/44*** | (2006.01) |
| ***B65H 75/48*** | (2006.01) |

(52) U.S. Cl.

CPC ..... *E01F 13/028* (2013.01); *B65H 75/4471* (2013.01); *B65H 75/48* (2013.01); *E01F 13/022* (2013.01)

(58) Field of Classification Search

CPC .. E01F 13/028; E01F 13/022; B65H 75/4471; B65H 75/48

See application file for complete search history.

(56) References Cited

U.S. PATENT DOCUMENTS

| | | | | |
|---|---|---|---|---|
| 4,844,420 | A | 7/1989 | Oster | |
| 6,119,621 | A | 9/2000 | Johnson | |
| 6,375,164 | B1 | 4/2002 | Siegler et al. | |
| 6,485,225 | B1 | 11/2002 | Baker | |
| 6,776,398 | B1 | 8/2004 | Tsai | |
| 6,830,236 | B2 | 12/2004 | Augusto de Lorenzo | |
| 7,316,388 | B2 | 1/2008 | Prismall | |
| 7,909,310 | B2 | 3/2011 | Weiner | |
| 2002/0063248 | A1 * | 5/2002 | Siegler | E01F 13/028 256/37 |
| 2006/0118377 | A1 * | 6/2006 | Lai | B65H 75/40 191/12.4 |
| 2008/0251625 | A1 | 10/2008 | Bentley | |
| 2009/0293191 | A1 | 12/2009 | Koyzan et al. | |
| 2010/0314480 | A1 * | 12/2010 | Gallacher | B65H 75/446 242/379 |
| 2011/0120823 | A1 | 5/2011 | Hansen et al. | |
| 2011/0209838 | A1 * | 9/2011 | Santora | A47B 95/00 160/323.1 |

(Continued)

*Primary Examiner* — Jonathan Masinick

(74) *Attorney, Agent, or Firm* — West & Associates, a PC; Stuart West

(57) ABSTRACT

A hand-held barrier apparatus for forming a barrier between surfaces a hand-held housing, a pliable longitudinal element, and a first connector. The longitudinal element is retractably extendable from the hand-held housing and includes a first coupling member supported on an end thereof. The first coupling member has a mating surface. The first connector is configured to be movably disposed on the longitudinal element. The first connector has a first mating surface configured for detachable connection with the mating surface of the first coupling member of the longitudinal element such that the longitudinal element forms a first loop upon detachable connection of the first connector with the first coupling member of the longitudinal element.

15 Claims, 10 Drawing Sheets

(56) References Cited

U.S. PATENT DOCUMENTS

| | | | | |
|---|---|---|---|---|
| 2012/0001008 | A1* | 1/2012 | Huang | B65H 75/48<br>242/375 |
| 2012/0153064 | A1* | 6/2012 | Votel | B65H 75/48<br>242/378.4 |

* cited by examiner

BARRIER APPARATUS AND METHODS OF USE

CROSS-REFERENCE TO RELATED APPLICATION

This application claims the benefit of and the priority to U.S. Provisional Patent Application No. 61/935,563, filed on Feb. 4, 2014, the entire contents of which are incorporated by reference herein.

TECHNICAL FIELD

The present disclosure generally relates to barriers, and more particularly, to versatile portable barriers for fencing in or closing off a designated area.

BACKGROUND

Barriers and/or fencing systems are used to block off a designated area and/or to delineate a pathway in various settings including, for example, airport security, shopping check-out lines, theme park lines, etc. Barriers can also be used to demarcate a perimeter of a crime scene, a scene of an accident or a job site and/or also include visual indicia to passersby. For a general description of an exemplary portable barrier apparatus and its component parts, reference can be made to U.S. Pat. No. 7,909,310, filed on Nov. 19, 2007, the entire contents of which are incorporated by reference herein.

There is a need for improved systems and methods of delineating or blocking off selected areas.

SUMMARY

In accordance with an embodiment of the present disclosure, a hand-held barrier apparatus is provided and includes a hand-held housing, a pliable longitudinal element, and a first connector. The longitudinal element has a first end and a second end. The first end is disposed within and rotatably coupled to the hand-held housing. The second end is retractably extendable from the hand-held housing and includes a first coupling member supported thereon. The first coupling member has a mating surface. The first connector is configured to be movably disposed on the longitudinal element. The first connector has a first mating surface configured for detachable connection with the mating surface of the first coupling member of the longitudinal element such that the longitudinal element forms a first loop upon detachable connection of the first connector with the first coupling member of the longitudinal element.

In some embodiments, the first connector may have a second mating surface, opposite the first mating surface of the first connector. The second mating surface of the first connector is configured for detachable connection with the mating surface of the first coupling member of the longitudinal element. The first and second mating surfaces of the first connector may each have a T-shaped transverse cross-section configuration. The mating surface of the first coupling member may define a longitudinally extending channel configured for slidable receipt of the first and second mating surfaces of the first connector.

It is contemplated that the first connector may include a central body defining a channel therethrough having the longitudinal element disposed therein. The first and second mating surfaces of the first connector may project from opposite sides of the central body.

It is envisioned that the first connector may be configured to detachably couple to the hand-held housing.

In some aspects, the hand-held barrier apparatus may further include a second coupling member and a second connector. The second coupling member may be disposed on the hand-held housing and have a mating surface. The second connector may be movably disposed on the longitudinal element and have a mating surface configured for detachable connection with the mating surface of the second coupling member of the hand-held housing. The longitudinal element forms a second loop upon detachable connection of the second connector with the second coupling member of the hand-held housing.

In some embodiments, the hand-held barrier apparatus may further include a hook connected to a side surface of the hand-held housing. The hand-held barrier apparatus may include a first hook and a second hook each pivotably connected to the side surface of the hand-held housing.

It is contemplated that the hand-held barrier apparatus may further include an anchoring member extendable from the hand-held housing and configured for penetrating a surface to fix the hand-held housing to the surface.

It is envisioned that the hand-held housing may have a side surface defining a cavity therein configured for removable receipt of a free-standing stanchion.

In some aspects, the longitudinal element may be approximately 150 feet in length.

In some embodiments, the hand-held housing may include a handle and a lock disposed adjacent the handle for locking the second end of the longitudinal element in a selected position relative to the hand-held housing.

In another aspect of the present disclosure, a method of forming a barrier between vertically oriented base supports is provided. The method includes providing the hand-held barrier apparatus disclosed herein. The longitudinal element is wrapped around at least two vertically oriented base supports. The mating surface of the first coupling member is connected to the first mating surface of the first connector to form a loop around the at least two vertically oriented base supports. The first connector is moved along the longitudinal element into engagement with one of the at least two vertically oriented base supports to form a barrier between the at least two vertically oriented base supports.

In some embodiments, the method may further include detachably coupling the hand-held housing to the first connector.

It is contemplated that the longitudinal element may be further extended from the hand-held housing and the hand-held housing may be wrapped around another vertically oriented base support. The mating surface of the second coupling member of the hand-held housing may be connected to the mating surface of the second connector to form a loop around the another vertically oriented base support. The second connector may be moved along the longitudinal element into engagement with the another vertically oriented base support to form a barrier between the another vertically oriented base support and one of the at least two vertically oriented base supports.

BRIEF DESCRIPTION OF THE DRAWINGS

The present disclosure will become more readily apparent from the specific description accompanied by the following drawings, in which.

DETAILED DESCRIPTION

Figure 1:
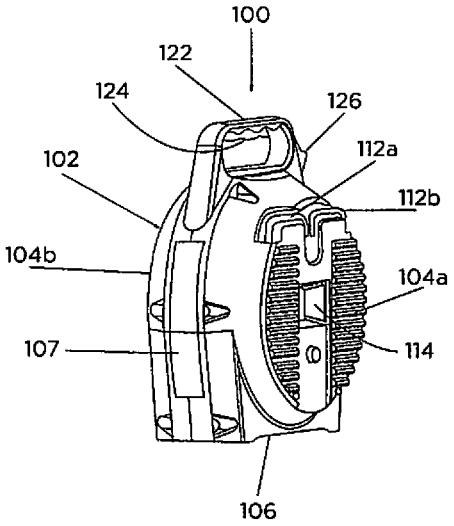
FIG. 1 is a rear, perspective view of one embodiment of a hand-held barrier apparatus illustrating a longitudinal element of the barrier apparatus disposed within a hand-held housing of the barrier apparatus.

The exemplary embodiments of the barrier apparatus, barrier system and related methods of use disclosed are described in terms of barriers, and more particularly, in terms of a hand-held barrier apparatus designed for fencing in or closing off a designated area or areas.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The components disclosed herein can be fabricated from metals, magnetic materials, synthetic polymers, and ceramics. The components disclosed herein, individually or collectively, may also be fabricated from materials such as plastic, nylon, stainless steel alloys, aluminum, commercially pure titanium, titanium alloys, Grade 5 titanium, super-elastic titanium alloys, cobalt-chrome alloys, stainless steel alloys, superelastic metallic alloys (e.g., Nitinol, super elasto-plastic metals, such as GUM METAL® manufactured by Toyota Material Incorporated of Japan), ceramics and composites thereof such as calcium phosphate (e.g., SKELITE™ manufactured by Biologix Inc.), thermoplastics such as polyaryletherketone (PAEK) including polyetheretherketone (PEEK), polyetherketoneketone (PEKK) and polyetherketone (PEK), carbon-PEEK composites, PEEK-BaSO4 polymeric rubbers, polyethylene terephthalate (PET), fabric, silicone, polyurethane, silicone-polyurethane copolymers, polymeric rubbers, polyolefin rubbers, hydrogels, semi-rigid and rigid materials, elastomers, rubbers, thermoplastic elastomers, thermoset elastomers, elastomeric composites, rigid polymers including polyphenylene, polyamide, polyimide, polyetherimide, polyethylene, epoxy. Various components disclosed herein may have material composites, including the above materials, to achieve various desired characteristics such as strength, rigidity, elasticity, compliance, and durability. The components disclosed herein, individually or collectively, may also be fabricated from a heterogeneous material such as a combination of two or more of the above-described materials. The components disclosed herein may be monolithically formed, integrally connected or include fastening elements and/or instruments, as described herein.

With reference to FIGS. 1-4, an embodiment of a hand-held barrier apparatus 100 for forming a barrier between surfaces is provided. Barrier apparatus 100 generally includes a hand-held housing 102, a pliable longitudinal element 130, and a first connector 140. Hand-held housing 102 is sized and configured to be detachably coupled to a waist of a user and held in a user's hands. Hand-held housing 102 has a generally oblong, semi-circular shape. In particular, hand-held housing 102 has first and second opposing lateral side surfaces 104*a*, 104*b*, a base surface 106, and an arcuate intermediate surface 107 that interconnects first and second lateral side surfaces 104*a*, 104*b*.

Figure 2:
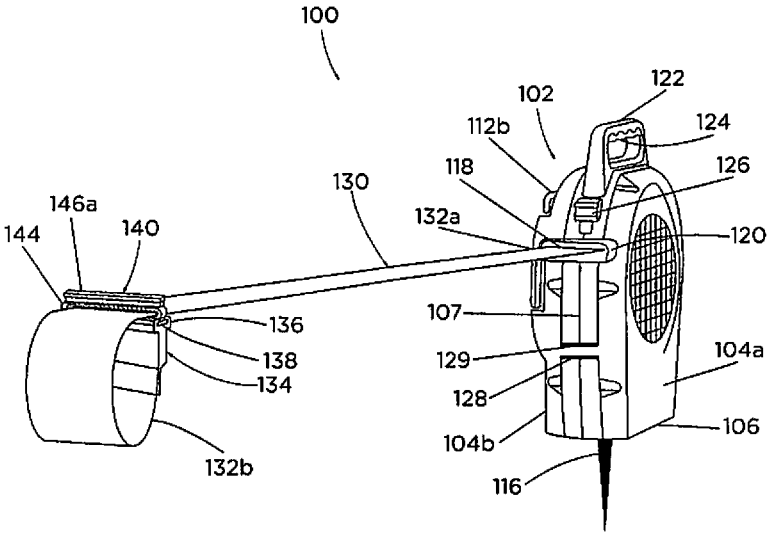
FIG. 2 is a front, perspective view of the barrier apparatus shown in FIG. 1 with the longitudinal element extended from the hand-held housing.

With reference to FIGS. 1 and 2, hand-held housing 102 includes a pair of hooks 112*a*, 112*b* that are pivotably connected to lateral side surface 104*a*. Hooks 112*a*, 112*b* can be pivoted relative to hand-held housing 102 from a first condition, in which hooks 112*a*, 112*b* are coplanar with lateral side surface 104*b*, and a second condition, in which hooks 112*a*, 112*b* extend from lateral side surface 104*b*. In the second condition, hooks 112*a*, 112*b* may be attached or latched onto a fixture, such as, for example, a chain link fence to hang barrier apparatus 100 thereon. Lateral side surface 104*a* defines a cavity 114 therein configured for removable retention of an end of a free-standing stanchion (not shown).

Hand-held housing 102 may further include an anchoring or penetrating member 116, such as, for example, a spike, configured for penetrating a surface, such as, for example, soft ground or a tree, to fix or anchor hand-held housing 102 with the surface. Penetrating member 116 is operably coupled to base 106 of hand-held housing 102 and extendable therefrom. In particular, penetrating member 116 may be folded out from base 106 to an extended state in which penetrating member 116 is perpendicular to base 106, as shown in FIG. 2.

With reference to FIG. 2, intermediate side surface 107 of hand-held housing 102 defines a horizontal slit 118 therein from which longitudinal element 130 extends. Intermediate side surface 107 has a mating feature 120 that surrounds horizontal slit 118 and extends from intermediate side surface 107. Mating feature 120 of hand-held housing 102 is configured to be detachably connected to a central body 144 of first connector 140 to secure first connector 140 to hand-held housing 102, as will be described in greater detail below.

Hand-held housing 102 may further include a coupling member 128 disposed on intermediate side surface 107. Coupling member 128 has a mating surface 129 configured to be detachably coupled to a connector 150 (FIG. 4) disposed on longitudinal element 130. Coupling member 128 and connector 150 (FIG. 4) are similar to first coupling member 134 and first connector 140, respectively, which will be described in detail below.

With continued reference to FIGS. 1 and 2, hand-held housing 102 further includes a handle portion 122 extending from a top portion of intermediate side surface 107 of hand-held housing 102. Handle portion 122 has an ergonomic gripping portion 124 to be gripped by a user's hand. Hand-held housing 102 has a thumb lock 126 disposed adjacent handle portion 122 and in operative association with longitudinal element 130 to selectively lock longitudinal element 130 in a selected, extended position relative to hand-held housing 102.

Figure 3:
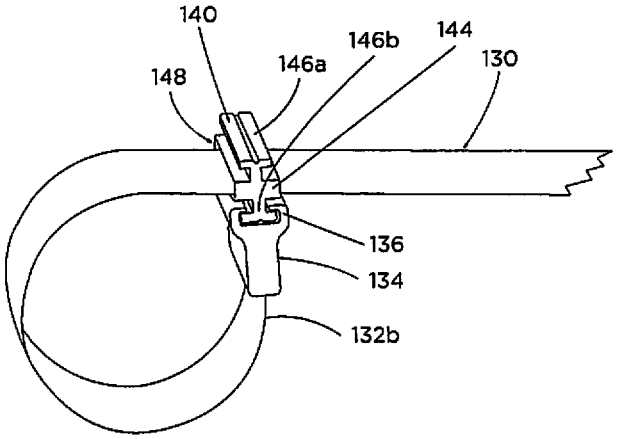
FIG. 3 is an enlarged, cutaway view of the longitudinal element of the barrier apparatus including a first coupling member coupled to a first connector to form a loop.
Figure 4:
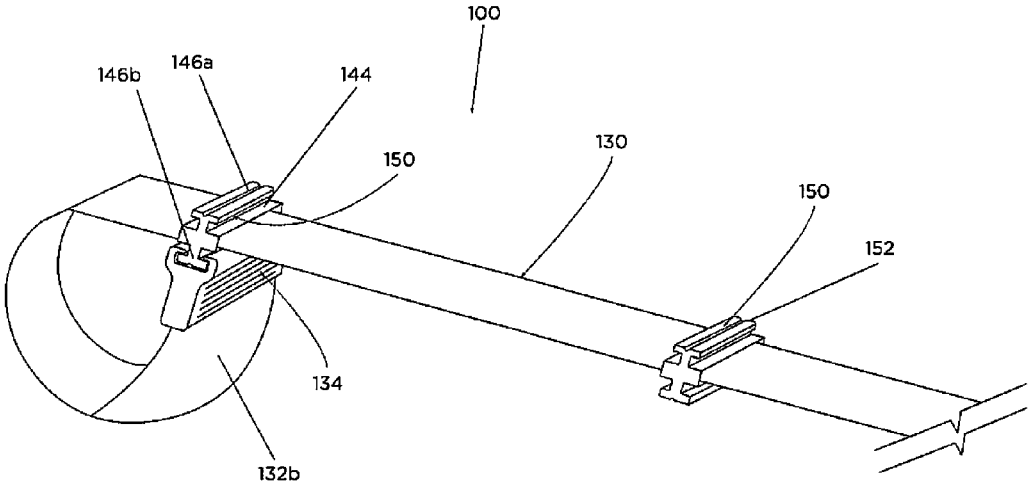
FIG. 4 is an enlarged, cutaway view of the longitudinal element including a second connector disposed thereon.

With reference to FIGS. 2-4, longitudinal element 130 of barrier apparatus 100 can be in the form of a ribbon, belt, tape, tether, or rope, and can be fabricated from various materials, such as, for example, nylon, polyester fabric or any suitably pliable or bendable material. In embodiments, longitudinal element 130 may be approximately between 100-200 feet in length. In some embodiments, longitudinal element 130 may have a fully extended length of approximately 150 feet.

Longitudinal element 130 has a first end 132*a* and a second end 132*b*. First end 132*a* is coupled to a spindle (not shown) rotatably disposed within hand-held housing 102 such that first end 132*a* is rotatable within hand-held housing 102. A rewind tension spring (not shown) is disposed within hand-held housing 102 and in engagement with the spindle to resiliently bias the spindle toward a wound condition. For a general description of the operation of a rewind tension spring, reference can be made to U.S. patent application Ser. No. 14/085,863, filed on Nov. 21, 2013, and U.S. Pat. No. 7,909,310, filed on Nov. 19, 2007, the entire contents of each of which are incorporated by reference herein.

Second end 132*b* of longitudinal element 130 is retractably extendable from hand-held housing 102. Second end 132*b* of longitudinal element 130 includes a first coupling member 134 supported thereon. Coupling member 134 has a mating surface 136 in the form of a c-clip. Mating surface 136 defines a longitudinally extending channel 138 configured for slidable receipt of a correspondingly shaped mating surface 146*a* or 146*b* of first connector 140, as will be described in greater detail below. Mating surface 136 of coupling member 134 captures or retains first connector 140 in channel 138 to detachably couple second end 132*b* of longitudinal element 130 with first connector 140.

First connector 140 of barrier apparatus 100 is configured for movable, slidable, or translatable connection to longitudinal element 130 such that first connector 140 can be moved along a length of longitudinal element 130 to a selected position on longitudinal element 130 between hand-held housing 102 and first coupling member 134 of longitudinal element 130. It is contemplated that first connector 140 may be configured to be selectively adjustable between a first condition, in which first connector 140 is slidable along longitudinal element 130, and a second condition, in which first connector 140 is fixed relative to longitudinal element 130. It is further contemplated that first connector 140 is frictionally engaged to longitudinal element 130 such that a threshold amount of force is required to move first connector 140 along longitudinal element 130.

First connector 140 includes a central body 144, a first mating surface 146*a*, and a second mating surface 146*b*. Central body 144 is tubular and has an oblong configuration. Central body 144 defines a channel 148 therethrough having longitudinal element 130 slidably received therein. In some embodiments, central body 144 may assume a variety of configurations, such as, for example, circular, squared, or the like. First and second mating surfaces 146*a*, 146*b* of first connector 140 are each configured for detachable connection with mating surface 136 of first coupling member 134 of longitudinal element 130. Longitudinal element 130 may be formed into a loop upon the detachable connection of connector 140 with first coupling member 134.

First mating surface 146*a* of first connector 140 projects from a first side of central body 144 and second mating surface 146*b* of first connector 140 projects from a second side of central body 144, opposite the first side of central body 144. First and second mating surfaces 146*a*, 146*b* of first connector 140 each have a T-shaped transverse cross section configuration corresponding to a cross-section of channel 138 of first coupling member 134 of longitudinal element 130. In some embodiments, first and second mating surfaces 146*a*, 146*b* of first connector 140 may assume a variety of configurations in which first and second mating surfaces 146*a*, 146*b* are slidably receivable within channel 138 of first coupling member 134 and captured therein. It is contemplated that either of mating surfaces 146*a*, 146*b* may be connected to a mating surface of another component of barrier apparatus 100 or another barrier apparatus.

With reference to FIG. 4, in some embodiments, barrier apparatus 100 may include a second connector 150, similar to first connector 140 described above, configured for movable connection to longitudinal element 130. Second connector 150 is disposed along longitudinal element 130 in a position closer to hand-held housing 102 than is first connector 140. Second connector 150 has a mating surface 152 configured for detachable connection with mating surface 129 (FIG. 2) of second coupling member 128 (FIG. 2) disposed on hand-held housing 102. Longitudinal element 130 forms a loop upon detachable connection of second coupling member 128 of hand-held housing 102 with second connector 150. As such, a first loop may be formed by connecting first coupling member with first connector, and a second loop may be formed by connecting second coupling member with second connector.

In use, a barrier may be formed between two vertically oriented base supports (not shown) spaced from one another. To accomplish this, a user applies a force, oriented in a direction away from hand-held housing 102, to second end 132*b* of longitudinal element 130 to extend longitudinal element 130 from hand-held housing 102. Upon extending longitudinal element 130 to a selected distance from hand-held housing 102, longitudinal element 130 may be wrapped around the two base supports. Mating surface 136 of first coupling member 134 of longitudinal element 130 is connected with mating surface 146*b* of first connector 140 to form a loop around the base supports. To fix the loop at a desired height on the two base supports, longitudinal element 130 is simultaneously retracted as first connector 140 is moved along longitudinal element 130 into engagement with a first of the two base supports to tighten longitudinal element 130 around the first and a second of the base supports. Thus, a barrier is formed between the first and second base supports.

Upon forming a tight fit around the base supports, mating feature 120 (FIG. 2) of hand-held housing 102 may be connected to central body 144 of first connector 140. Alternately, a force may be applied to hand-held housing 102 to further extend longitudinal element 130 from hand-held housing 102 and to distance hand-held housing 102 from first connector 140 of longitudinal element 130 and the first base support. Hand-held housing 102 may be wrapped around a third vertically oriented base support, which is distanced from the first and second base supports. Mating surface 129 (FIG. 2) of second coupling member 128 (FIG. 2) of hand-held housing 102 may be connected to mating surface 152 (FIG. 4) of second connector 150 disposed on longitudinal element 130 to form a loop around the third vertically oriented base support. Upon forming a loop around the third base support, second connector 150 may be moved along longitudinal element 130 into engagement with the third base support to form a barrier between the first and third base supports. As such, barrier apparatus 100 may form a first barrier between the first and second base supports, and a second barrier between the first and third base supports.

With reference to FIGS. 5-10, an embodiment of a barrier system 200 is provided. Barrier system 200 includes a barrier apparatus or spool head 300 for forming a barrier between surfaces, a stanchion 400, and an adapter 500 for coupling spool head 300 and stanchion 400, as will be described in detail below.

Figure 5:
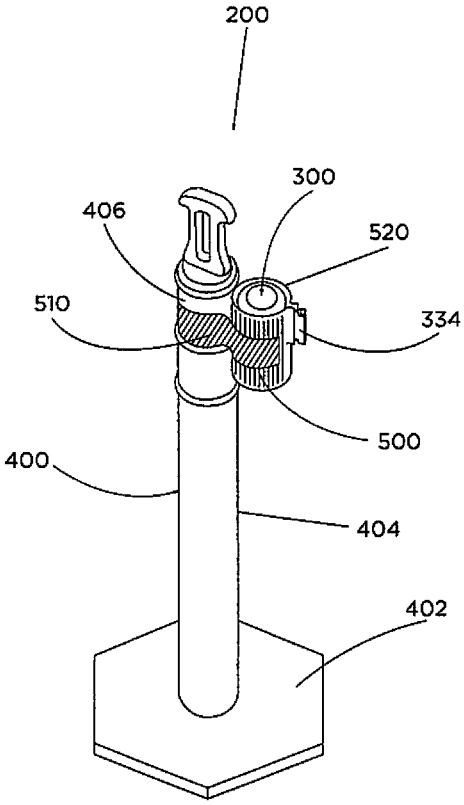
FIG. 5 is a perspective view of a barrier system including a stanchion adapter, a portable spool head, and a stanchion, in accordance with further principles of the present disclosure.
Figure 6:
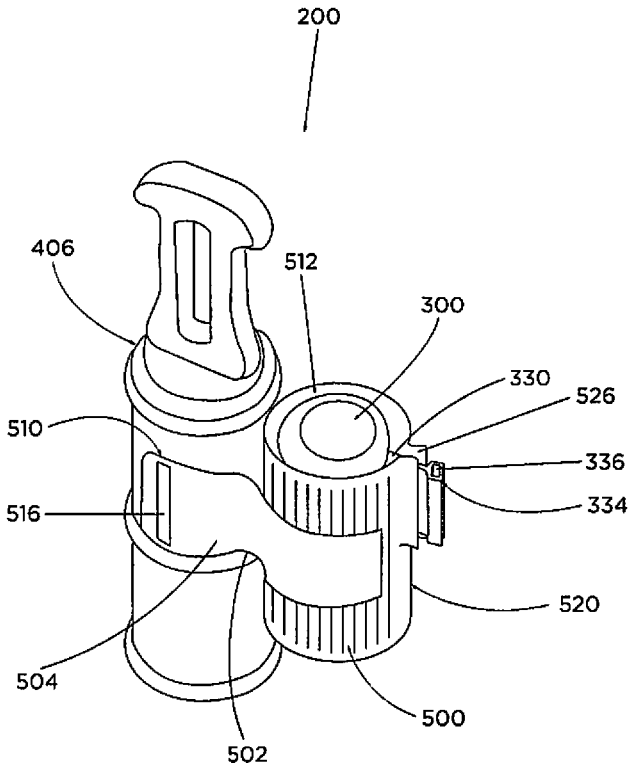
FIG. 6 is a perspective view of components of the barrier system of FIG. 5.

With reference to FIGS. 5 and 6, stanchion 400 of barrier system 200 has a base portion 402, an elongate shaft or tube 404, and a top portion or head 406. Base portion 402 has a planar configuration to provide stability for stanchion 400 when stanchion 400 is resting on the ground in its intended vertical orientation. Elongate shaft 404 extends upwardly from base portion 402 in a perpendicular orientation relative to base portion 402, and has a height of approximately 3-5 feet. In some embodiments, elongate shaft 404 may be any suitable height and may have an adjustable height by being comprised of a series of telescoping tubes. Head 406 of stanchion 400 is supported on elongate shaft 404 and may be detachable from elongate shaft 404. Head 406 is configured for disposal and retention in a channel 512 of a stanchion connector 510 of adapter 500, as will be described in greater detail below.

Figure 7:
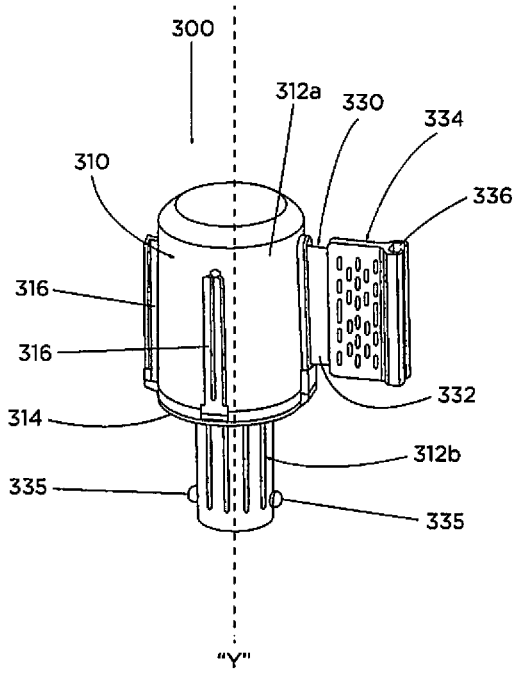
FIG. 7 is a perspective view of the portable spool head of the barrier system of FIG. 5.

With reference to FIGS. 5-7, spool head 300 of barrier system 200 generally includes a spool housing 310 and a pliable longitudinal element 330 retractably extendable from spool housing 310. Spool head 300 further includes a spool (not shown) rotatably disposed within spool housing 310 and a rewind tension spring (not shown) in engagement with the spool to resiliently bias the spool toward a wound condition. Spool housing 310 defines a longitudinal axis "Y" extending between a top portion or head 312*a* thereof and a bottom portion or base 312*b* thereof. Top portion 312*a* of spool housing 310 has a cylindrical configuration. Top portion 312*a* has an outer surface 314 and a plurality of mounting members 316 projecting from outer surface 314. Mounting members 316 each have a length that extends parallel to longitudinal axis "Y" of spool housing 310. Mounting members 316 have a T-shaped transverse cross-section configuration corresponding to a mating surface 336 of a coupling member 334 of longitudinal element 330. As such, coupling members from various longitudinal elements (e.g., ropes, belts, banners, ribbons, or other barriers) can be coupled to mounting members 316 of spool housing 310 at various circumferential locations along spool housing 310.

With specific reference to FIG. 7, bottom portion 312*b* of spool housing 310 extends from top portion 312*a*. Bottom portion 312*b* may have a cylindrical configuration having a smaller diameter than a diameter of top portion 312*a* such that top portion 312*a* has a seating surface configured to abut a platform 528 (FIG. 8) of spool head housing 520 of adapter 500, as will be described in greater detail below. Bottom portion 312*b* of spool housing 310 includes a pair of push pin locks 335 configured to be detachably locked to corresponding mating features of stanchion 400, adapter 500, and/or a wall mount (not shown), as will be described in greater detail below.

Longitudinal element 330 of spool head 300 is disposable within spool housing 310. Longitudinal element 330 has a first end (not shown) and a second end 332. The first end is coupled to the spool (not shown) and wrapped thereabout. Second end 332 of longitudinal element 330 has a coupling member 334, similar to coupling member 134 described above with reference to FIGS. 1-4, supported thereon. Coupling member 334 has a mating feature 336 configured for removably receipt of mounting members 316 of spool housing 310. In use, as a force is applied to second end 332 of longitudinal element 330 in a direction oriented perpendicular to longitudinal axis "Y" of spool housing 310, the spool disposed within spool housing 310 rotates to extend second end 332 of longitudinal element 330 from spool housing 310. With longitudinal element 330 in the extended state, mating feature 336 of coupling member 334 of longitudinal element 330 can be mounted or coupled to one of mounting members 316 of spool housing 310 to form a loop.

With continued reference to FIGS. 5-10, adapter 500 of barrier system 200 is configured to detachably couple spool head 300 with stanchion 400. It is contemplated that adapter 500 can be made of a crush-proof material. Adapter 500 includes a first portion or stanchion connector 510 configured for receipt of stanchion head 406, and a second portion or spool head housing 520 configured for receipt of spool head 300. Adapter 500 includes a bridge 502 interconnecting stanchion connector 510 of adapter 500 to spool head housing 520 of adapter 500. In some embodiments, connector 510 and housing 520 may be integrally connected to, or monolithically formed with, one another.

Stanchion connector 510 of adapter 500 includes a wall 504 having a cylindrical configuration. Wall 504 defines a channel 512 therethrough configured to receive head 406 of stanchion 400. Stanchion connector 510 may be in the form of a C-clip configured to capture an outer surface of head 406 of stanchion 400 such that adapter 500 is configured for snap-fitting engagement with stanchion 400. It is contemplated that stanchion connector 510 is fabricated from a material capable of flexing to increase a diameter of wall 504 thereof to enhance the frictional engagement between stanchion connector 510 of adapter 500 and stanchion head 406.

Figure 8:
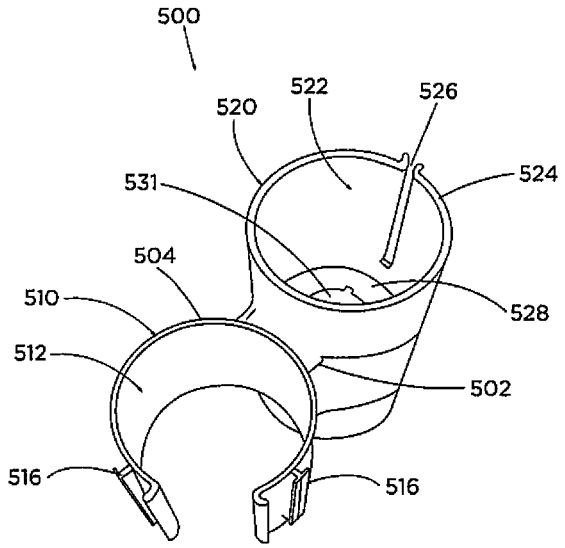
FIG. 8 is a top, perspective view of the stanchion adapter of the barrier system of FIG. 5.

With reference to FIG. 8, stanchion connector 510 of adapter 500 has a plurality of mating surfaces 516 projecting from an outer surface of wall 504. Mating surfaces 516 of stanchion connector 510 are configured for connection to a corresponding mating feature, such as, for example, mating surface 336 of coupling member 334 of spool head 300 or mating surface 136 of coupling member 134 of longitudinal element 130 of barrier apparatus 100 (FIGS. 1-4).

Spool head housing 520 of adapter 500 includes a cylindrical wall 524 that defines a cavity 522 therein configured for disposal of a spool head, such as, for example, spool head 300. Wall 524 of spool head housing 520 defines a slot or slit 526 that extends longitudinally along wall 524. Slot 526 is in communication with cavity 522 and configured for sliding disposal of longitudinal element 330 of spool head 300. Spool head housing 520 has a ring-shaped platform 528 formed within cavity 522, below slot 526 of wall 524, configured to act as a resting surface for top portion 312*a* of spool head 300.

Figure 9:
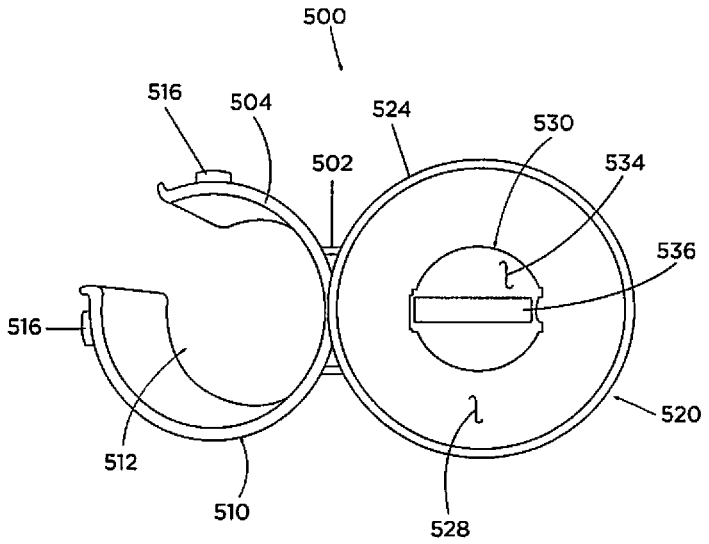
FIG. 9 is an underneath view of the stanchion adapter of FIG. 8.
Figure 10:
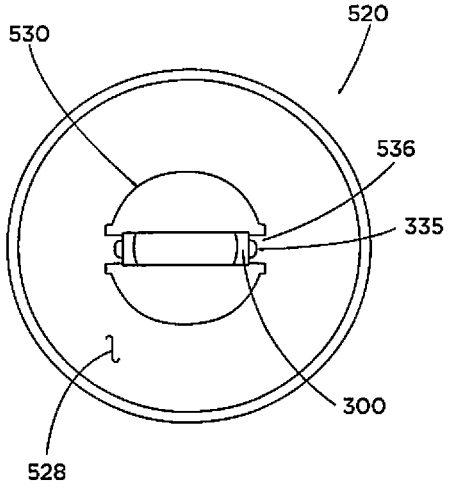
FIG. 10 is an enlarged, underneath view of the stanchion adapter of FIG. 8.

With reference to FIGS. 9 and 10, spool head housing 520 further includes a tubular extension 530 extending downwardly from platform 528 to define a counterbore 531 (FIG. 8). Extension 530 has a top end connected to platform 528 and a bottom end 534 defining an opening 536 configured for disposal of push pin locks 335 of bottom portion 312*b* of spool head 300. As such, upon full receipt of spool head 300 within cavity 522 of spool head housing 522 of adapter 500, push pin locks 335 of bottom portion 312*b* of spool head 300 extend radially outward into openings 536 of tubular extension 530 to selectively lock spool head 300 to adapter 500.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A hand-held barrier apparatus, comprising:

a hand-held housing;

a pliable longitudinal element having a first end and a second end, the first end being disposed within and rotatably coupled to the hand-held housing, the second end being retractably extendable from the hand-held housing and including a first coupling member supported thereon, the first coupling member having a mating surface; and a first connector configured to be movably disposed on the longitudinal element, the first connector having a first mating surface configured for detachable connection with the mating surface of the first coupling member of the longitudinal element, wherein the longitudinal element forms a first loop upon detachable connection of the first mating surface of the first connector with the mating surface of the first coupling member of the longitudinal element.

2. The hand-held barrier apparatus according to claim 1, wherein the first connector has a second mating surface, opposite the first mating surface of the first connector, the second mating surface of the first connector configured for detachable connection with the mating surface of the first coupling member of the longitudinal element.

3. The hand-held barrier apparatus according to claim 2, wherein the first and second mating surfaces of the first connector each have a T-shaped transverse cross-sectional configuration, and the mating surface of the first coupling member defines a longitudinally extending channel configured for slidable receipt of the first and second mating surfaces of the first connector.

4. The hand-held barrier apparatus according to claim 2, wherein the first connector includes a central body defining a channel therethrough having the longitudinal element disposed therein, the first and second mating surfaces of the first connector projecting from opposite sides of the central body.

5. The hand-held barrier apparatus according to claim 1, wherein the first connector is configured to detachably couple to the hand-held housing.

6. The hand-held barrier apparatus according to claim 1, further comprising:

a second coupling member disposed on the hand-held housing and having a mating surface; and a second connector movably disposed on the longitudinal element, the second connector having a mating surface configured for detachable connection with the mating surface of the second coupling member of the hand-held housing, wherein the longitudinal element forms a second loop upon detachable connection of the second connector with the second coupling member of the hand-held housing.

7. The hand-held barrier apparatus according to claim 1, further comprising at least one hook connected to a side surface of the hand-held housing.

8. The hand-held barrier apparatus according to claim 7, wherein the at least one hook includes a first hook and a second hook each pivotably connected to the side surface of the hand-held housing.

9. The hand-held barrier apparatus according to claim 1, further comprising an anchoring member extendable from the hand-held housing and configured for penetrating a surface to fix the hand-held housing to the surface.

10. The hand-held barrier apparatus according to claim 1, wherein the hand-held housing has a side surface defining a cavity therein configured for removable receipt of a free-standing stanchion.

11. The hand-held barrier apparatus according to claim 1, wherein the longitudinal element is approximately 150 feet in length.

12. The hand-held barrier apparatus according to claim 1, wherein the hand-held housing includes:

a handle; and a lock disposed adjacent the handle for locking the second end of the longitudinal element in a selected position relative to the hand-held housing.

13. A method of forming a barrier between vertically oriented base supports, the method comprising:

providing a hand-held barrier apparatus, including:

a hand-held housing;

a pliable longitudinal element having a first end and a second end, the first end being disposed within and rotatably coupled to the hand-held housing, the second end being retractably extendable from the hand-held housing and including a first coupling member supported thereon, the first coupling member having a mating surface; and a first connector configured to be movably disposed on the longitudinal element, the first connector having a first mating surface configured for detachable connection with the mating surface of the first coupling member of the longitudinal element;

wrapping the longitudinal element around at least two vertically oriented base supports;

connecting the mating surface of the first coupling member to the first mating surface of the first connector to form a loop around the at least two vertically oriented base supports; and moving the first connector along the longitudinal element into engagement with one of the at least two vertically oriented base supports to form a barrier between the at least two vertically oriented base supports.

14. The method according to claim 13, further comprising detachably coupling the hand-held housing to the first connector.

15. The method according to claim 13, wherein the hand-held barrier apparatus further includes:

a second coupling member disposed on the hand-held housing and having a mating surface; and a second connector movably disposed on the longitudinal element, the second connector having a mating surface configured for detachable connection with the mating surface of the second coupling member of the hand-held housing;

the method further comprising:

extending the longitudinal element from the hand-held housing;

wrapping the hand-held housing around another vertically oriented base support;

connecting the mating surface of the second coupling member of the hand-held housing to the mating surface of the second connector to form a loop around the another vertically oriented base support; and moving the second connector along the longitudinal element into engagement with the another vertically oriented base support to form a barrier between the another vertically oriented base support and one of the at least two vertically oriented base supports.

* * * * *